US011795035B2

(12) United States Patent
Collins et al.

(10) Patent No.: US 11,795,035 B2
(45) **Date of Patent: *Oct. 24, 2023**

(54) LIFTING DEVICE AND METHODS FOR PULLING UP OVERTURNED VEHICLES AND OTHER STRUCTURES

(71) Applicant: B/A Products Co., Columbia, MD (US)

(72) Inventors: John D. Collins, Spencerville, MD (US); Mark Bailey, Spencerville, MD (US)

(73) Assignee: B/A Products Co., Columbia, MD (US)

( * ) Notice: Subject to any disclaimer, the term of this patent is extended or adjusted under 35 U.S.C. 154(b) by 36 days.

This patent is subject to a terminal disclaimer.

(21) Appl. No.: 17/404,122

(22) Filed: Aug. 17, 2021

(65) Prior Publication Data

US 2021/0371249 A1 Dec. 2, 2021

Related U.S. Application Data

(63) Continuation of application No. 16/678,893, filed on Nov. 8, 2019, now Pat. No. 11,111,111.

(60) Provisional application No. 62/767,899, filed on Nov. 15, 2018.

(51) Int. Cl.
*B66C 1/22* (2006.01)
*B66C 1/66* (2006.01)

(52) U.S. Cl.
CPC . *B66C 1/22* (2013.01); *B66C 1/66* (2013.01)

(58) Field of Classification Search
CPC ..... B66C 1/22; B66C 1/66; B66C 1/10
USPC ..... 294/81.1, 81.3, 81.5, 81.2, 81.21
See application file for complete search history.

(56) References Cited

U.S. PATENT DOCUMENTS

| | | | | |
|---|---|---|---|---|
| 1,852,758 | A | 1/1930 | Schroeder | |
| 2,721,757 | A | 10/1955 | Anderson | |
| 3,897,097 | A * | 7/1975 | Davis, Jr. | B66C 1/24 294/81.4 |
| 4,114,765 | A | 9/1978 | Kojima | |
| 4,223,612 | A | 9/1980 | Polley | |
| 4,289,090 | A | 9/1981 | Bagby | |
| 4,394,041 | A | 7/1983 | de Nachtegaal | |
| 4,397,493 | A | 8/1983 | Khachaturian et al. | |

(Continued)

FOREIGN PATENT DOCUMENTS

| | | |
|---|---|---|
| CN | 203639016 U | 6/2014 |
| CN | 106429788 A | 2/2017 |
| GB | 1516297 A | 7/1978 |

OTHER PUBLICATIONS

International Search Report and Written Opinion from corresponding international application No. PCT/US2019/060596, 15 pgs, dated Feb. 26, 2020.

(Continued)

*Primary Examiner* — Paul T Chin
(74) *Attorney, Agent, or Firm* — SHOOK, HARDY & BACON L.L.P.

(57) ABSTRACT

A lifting devices can include a tube with a first slot and a second slot. The devices also include an insert with a first insert projection connected to a second insert projection by a central portion. The first insert projection extends through the first slot and the second insert projection extends through the second slot. A first plate and a second plate are each connected to the central portion of the insert. The lifting devices can be used in a method of lifting a tanker truck or other structures.

20 Claims, 15 Drawing Sheets

(56) References Cited

U.S. PATENT DOCUMENTS

| | | | | |
|---|---|---|---|---|
| 4,565,399 | A * | 1/1986 | Cranston | B66C 1/12 294/74 |
| 4,597,602 | A | 7/1986 | McGriff | |
| 4,626,012 | A | 12/1986 | Weldele | |
| 4,831,967 | A | 5/1989 | Anderson | |
| 4,936,616 | A | 6/1990 | Williams | |
| 5,370,268 | A | 12/1994 | Adams | |
| 5,445,426 | A | 8/1995 | Sorensen | |
| 5,482,341 | A | 1/1996 | Schmitz, Jr. | |
| 5,820,184 | A | 10/1998 | Echenay | |
| 6,213,135 | B1 * | 4/2001 | Moulder | B08B 9/0936 134/167 R |
| 6,932,313 | B1 * | 8/2005 | Akrep | B66C 1/10 248/324 |
| 7,178,840 | B1 | 2/2007 | Veach | |
| 7,222,903 | B2 | 5/2007 | Tardiff | |
| 8,015,647 | B2 * | 9/2011 | Bennett | B65G 69/22 14/71.1 |
| 8,382,175 | B2 | 2/2013 | DiMartino | |
| 9,027,975 | B2 | 5/2015 | Meyer et al. | |
| 9,316,208 | B2 | 4/2016 | Friis | |
| 9,359,174 | B2 | 6/2016 | Stitt et al. | |
| 11,111,111 | B2 * | 9/2021 | Collins | B66C 1/22 |
| 2005/0199567 | A1 | 9/2005 | Tardiff | |
| 2005/0210771 | A1 | 9/2005 | Kuenzel | |
| 2005/0276673 | A1 * | 12/2005 | Alaweih | B65D 90/0033 410/68 |
| 2009/0072561 | A1 | 3/2009 | Latham | |
| 2016/0214837 | A1 | 7/2016 | Stitt et al. | |
| 2018/0201484 | A1 * | 7/2018 | Isringhausen | B66C 1/44 |
| 2021/0016333 | A1 * | 1/2021 | Belue | B08B 9/0813 |

OTHER PUBLICATIONS http:navyaviation.tpub.com/14313/css/Mk-18-Mod-1-Handling-Beam-203.htm; MK 18 MOD 1 Handlinq Beam, 3 paqes, downloaded Mar. 19, 2018.

http:www.tzlifute.com/eproducts/88.html, Lifting beam, Spreader Beam, Adjustable Spreader Beam, 1 page, downloaded Mar. 20, 2018.

http://www.verlinde.com/assets/gdf/Guide-techique-palonniers-frob.pd1, Palonniers Lifting Beams, 16 pages, Jun. 2016.

http:www.grainger.com/product/CALDWELL Battery Lifting Beam 5TDK2, Battery Lifting Beam, Low Headroom, 7000 lb., Max. Spread 45", Min. Spread 24", Headroom 18-1 /4, 4 pages, downloaded Mar. 20, 2018.

http://www.spartaengineering.com/speader bar vs lifting beams, Spreader Bars vs. Lifting Beams, 5 pages, 2013.

http://www triodyne corn/bib0817/bib00280040.pdf, Gregg Noll, The Gasoline Tank Truck: Rollover Emergencies, Fire Engineering, 7 pages, Jul. 1987.

* cited by examiner

LIFTING DEVICE AND METHODS FOR PULLING UP OVERTURNED VEHICLES AND OTHER STRUCTURES

CROSS-REFERENCE TO RELATED APPLICATIONS

The present patent document is a continuation application that claims the benefit of priority under 35 U.S.C. § 120 of U.S. patent application Ser. No. 16/678,893, filed Nov. 8, 2019, which claims the benefit of the filing date under 35 U.S.C. § 119(e) of Provisional U.S. Patent Application Ser. No. 62/767,899, filed Nov. 15, 2018. All of the foregoing applications are hereby incorporated by reference in their entirety.

BACKGROUND

Devices may be used for lifting purposes. Various methods of lifting are known in the art. For example, a hoisting bar may be attached to an item to be lifted and a lifting machine pulls the hoisting bar with the connected item upwards.

There are various situations in which an item may need to be lifted. For example, an overturned tanker truck to be uprighted. A tanker truck is a liquid-carrying vehicle and may transport hazardous materials such as gasoline, diesel, and waste oil. The tank of the truck is the portion that is capable of containing fluid. Generally, there are multiple openable hatchways located at the top of the truck tank. Non-hazardous fluids may also be transported using a tanker truck, for example, water or milk.

A tanker truck may overturn while it is holding fluid material in the tank or while the tank is empty. An overturned tanker truck poses problems. For example, the fluid could spill from the tank and, if flammable, catch on fire. An overturned tanker truck could be laying on an object, such as another vehicle. Also, a tanker truck usually overturns on a road, and an overturned truck could block the roadway causing a road closure or traffic delay.

A system of straps wrapped around a tanker truck is typically used to upright an overturned tanker truck. The straps are wrapped around the circumference of the tank and held at ends in a sling position by a lifting machine. The system of straps is connected to one or more cranes using chains, pulleys, and other connecting components. This lifting process takes a significant amount of time which makes lifting less efficient and results in longer roadway closures. This process generally takes hours to complete. Furthermore, since the strap system lifts the tanker truck from the bottom using a sling-shaped system, the tanker truck becomes top heavy during the lifting procedure which increases the chance of undesirable rolling which could cause further damage to the truck, lifting equipment, and surrounding objects. The strap system method of lifting a tanker truck also utilizes a pre-lift procedure for placement of the straps.

Another technique for lifting overturned tanker trucks is to insert a length of 4×4 or 6×6 lumber into a tanker truck's open hatchway, attach a sling around the piece of lumber, attach a snatch block or winch line to the sling, and use a machine to lift upwards on the sling. However, lumber is not load rated for purposes of lifting a tanker truck. Lumber is not a reliable device for lifting tanker trucks.

Tanker towers desire a faster, safer, and easier way to upright overturned tanker trucks. Also, generally, individuals needing to lift objects desire reliable devices for assistance.

BRIEF SUMMARY

Described herein are lifting devices. The lifting device includes a tube. The tube has a first slot and a second slot. The lifting device also includes an insert having a first insert projection connected to a second insert projection by a central portion. The first insert projection extends through the first slot and the second insert projection extends through the second slot. The lifting device also includes a first plate and a second plate. The first plate and the second plate are each connected to the central portion of the insert.

The tube has a longitudinal axis. A plurality of tube apertures are arranged in line with the longitudinal axis. The tube further comprises a first cap at a first end of the tube and a second cap at a second end of the tube. The tube has a circumference, and the first insert projection extends out of the tube at 0 degrees and the second insert projection extends out of the tube at 180 degrees. A length of the second slot is greater than a length of the first slot.

The first insert projection and the second insert projection are on a same plane. The first insert projection, the second insert projection, and the central portion of the insert together are an integral structure. A width of the first insert projection, a width of the central portion of the insert, and a width of the second insert projection are substantially the same. The first insert projection includes an aperture, the central portion of the insert includes a plurality of apertures, and the first foot and the second foot each include an aperture. The second insert projection may further include a first foot and a second foot.

The first plate and the second plate are each connected to the tube. The first plate and the second plate may each extend from a surface of the second insert projection to an internal surface of the tube. The first plate and the second plate may be welded to the tube and welded to at least a portion of the insert. Each of the first plate and the second plate are substantially rectangular with at least one angled side, wherein the at least one angled side of the first plate and the at least one angled side of the second plate are each connected to the central portion of the insert. Each of the first plate and the second plate are thinner than the second insert projection.

Each of the tube, the insert, the first plate, and the second plate include a non-sparking metal. The non-sparking metal may be aluminum. The lifting device may be configured to support a weight of at least 60,000 pounds. The lifting device may be configured to support a working load of at least 15,000 pounds.

Described herein are methods of lifting a tanker truck. Methods include obtaining a lifting device that includes a tube. The tube has a first slot and a second slot. The lifting device also includes an insert having a first insert projection connected to a second insert projection by a central portion. The first insert projection extends through the first slot and the second insert projection extends through the second slot. The lifting device also includes a first plate and a second plate. The first plate and the second plate are each connected to the central portion of the insert. The methods further include inserting the lifting device into a hatch of a tank of a tanker truck and applying an upwards force to the lifting device. The tanker truck is moved by the pressure applied by the lifting device to the inside of the tank. A length of the tube along the longitudinal axis of the tube is greater than a length of the hatch.

A method of lifting a tanker truck may further include obtaining a second lifting device that includes a tube. The tube has a first slot and a second slot. The second lifting device also includes an insert having a first insert projection connected to a second insert projection by a central portion. The first insert projection extends through the first slot and the second insert projection extends through the second slot. The second lifting device also includes a first plate and a second plate. The first plate and the second plate are each connected to the central portion of the insert. The methods further include inserting the second lifting device into a second hatch of the tank of the tanker truck and applying an upwards force to the second lifting device. Applying an upwards force to the lifting device is performed by a lifting machine. The lifting machine is connected to the first insert projection. The lifting machine is connected to the first insert projection by at least one intervening component.

Advantages of the disclosed devices will become more apparent to those skilled in the art from the following description of the embodiments that have been shown and described by way of illustration. As will be realized, the lifting devices are capable of other and different embodiments, and details are capable of modification in various respects. Accordingly, the drawings and description are to be regarded as illustrative in nature and not as restrictive.

DETAILED DESCRIPTION OF THE DRAWINGS

Reference to coupling or connection of components, unless specified otherwise, includes direct connection as well as connection through intervening components. Throughout this specification, unless otherwise specified or the context requires otherwise, the words "comprise" and "include" and variations such as "comprising," "including," and "having," will be understood to imply the inclusion of an item or group of items, but not the exclusion of any other item or group of items. The term "substantially" is specifically defined herein to include a range of plus or minus 5% of the value recited, inclusive of the value recited.

A lifting device 10 is provided in FIGS. 1-16.

Figure 1:
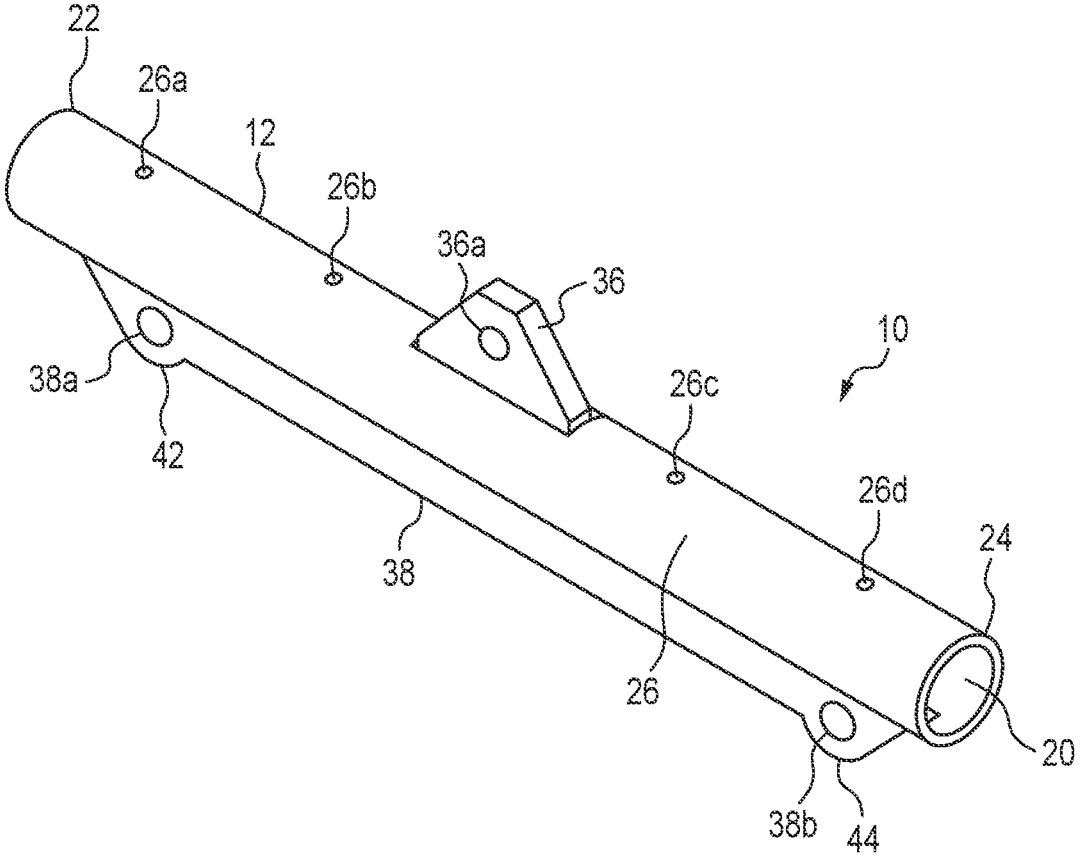
FIG. 1 is a top front perspective view of a lifting device.
Figure 2:
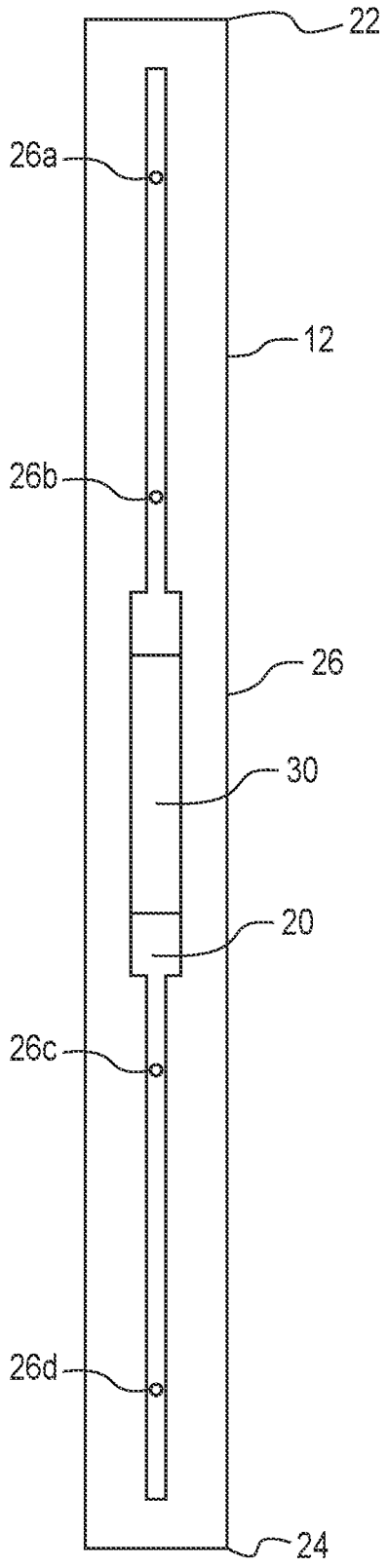
FIG. 2 is a bottom view of a tube of the lifting device of FIG. 1.
Figure 3:
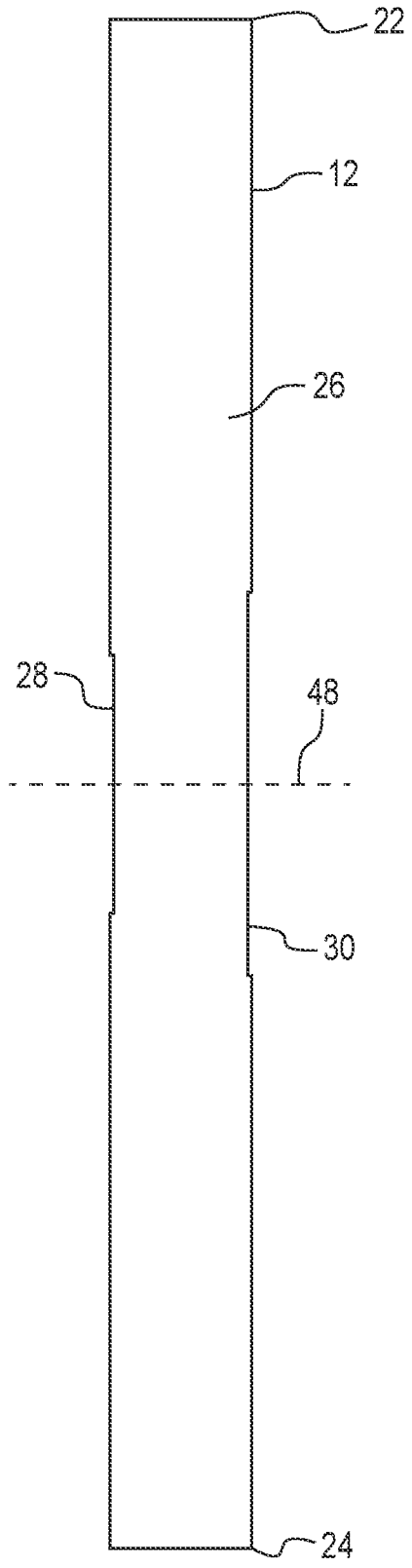
FIG. 3 is a side view of a tube of the lifting device of FIG. 1.
Figure 7:
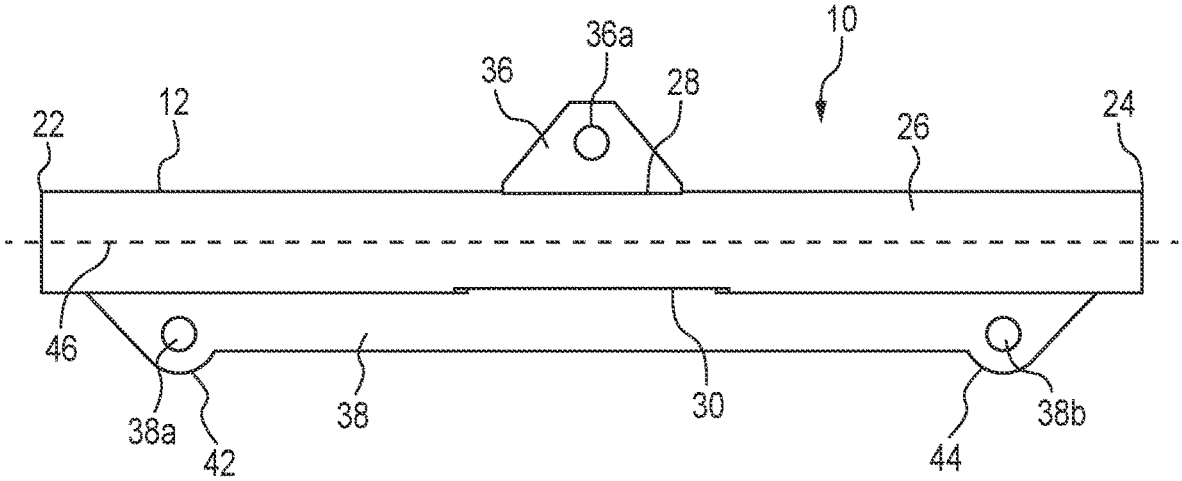
FIG. 7 is a side view of the lifting device of FIG. 1.

The lifting device 10 includes a tube 12, an insert 14, and two plates 16, 18. The tube 12 is an elongate tubular member that includes a lumen 20 defined therein. The tube 12 has a first end 22 and a second end 24. The tube may be about 48 inches from the first end 22 to the second end 24. A first cap (not shown) may be attached to the first end 22 and a second cap (not shown) may be attached to the second end 24. The tube sidewall 26 extends between the first end 22 and the second end 24. The tube sidewall 26 may have a cylindrical shape. The tube lumen 20 has a diameter. The diameter between a first point on the inner side of the tube sidewall 26 and an opposing second point on the inner side of the tube sidewall 26 (inner diameter or lumen diameter) may be about 4 inches. The diameter between a first point on the outer side of the tube sidewall 26 and an opposing second point on the outer side of the tube sidewall 26 (outer diameter of the tube 12) may be about 4.50 inches. One benefit of a diameter, for example, under 10 inches, allows a user to insert a lifting device 10 into a manway as small as about 10 inches in diameter. As shown in FIG. 7, a longitudinal axis 46 extends between and beyond the first end of the tube 22 and the second end of the tube 24. In some embodiments, for example as shown in FIG. 3, the tube 12 may be symmetrical about a lateral centerline 48 between the first and second ends 22, 24. The length from the first end 22 of the tube 12 to the tube lateral centerline 48 may be about 24 inches, and the length from the second end 24 of the tube 12 to the tube lateral centerline 48 may also be about 24 inches.

Figure 6:
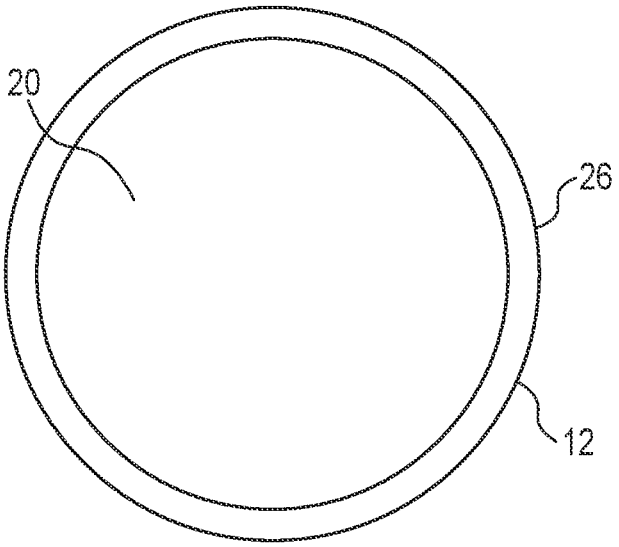
FIG. 6 is an end view of a tube of the lifting device of FIG. 1.

The tube 12 has a first slot 28 and a second slot 30. As shown in FIGS. 2-5, the slots 28, 30 are disposed within the tube sidewall 26. The length of the second slot 30 may be longer than the length of the first slot 28. For example, the length of the first slot may be about 8.13 inches (with a width of 1.56 inches) and the length of the second slot may be about 45 inches (with a varying width along the length of the tube 12 between about 0.63 inches and about 1.56 inches). Each slot 28, 30 (or portion thereof) may have a width so as to form an indent in the tube sidewall 26, as shown in the side view of FIG. 3. As shown in FIG. 3, the indents may be the same depth but the indents may also have different depths, depending on the width of each slot 28, 30. The tube 12 may have a circumference (as shown in FIG. 6), and the first slot 28 is located at 0 degrees and the second slot is located at 180 degrees. Therefore, the first slot 28 and the second slot 30 are across from each other and located on the same plane. Alternatively, the first slot 28 and the second slot 30 may be at different relative positions upon the tube 12. The distance between the first end 22 of the tube 12 and the second slot 30 may be about 1.50 inches and the distance between the second end 24 of the tube 12 and the second slot 30 may be about 1.50 inches.

The tube 12 may have three portions. A first portion which includes the first end 22, a second portion which includes the second end 24, and a third central portion that extends between the first portion and the second portion. The first slot 28 has a rectangular shape and is disposed at the third central portion of the tube 12. The second slot 30 has a rectangular shape but with a wider width at the third central portion of the tube 12 (a width of about 1.56 inches for a length of 12 inches along the tube 12) and a more narrow width at the first portion of the tube 12 (a width of about 0.63 inches for a length of about 16.50 inches) and the second portion of the tube 12 (a width of about 0.63 inches for a length of about 16.50 inches).

Figure 4:
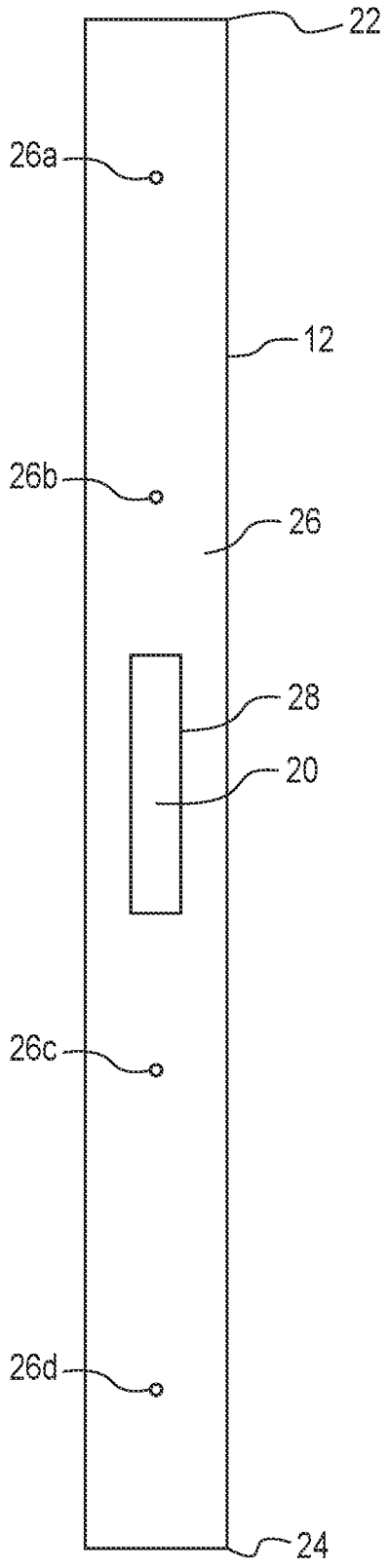
FIG. 4 is a top view of a tube of the lifting device of FIG. 1.
Figure 5:
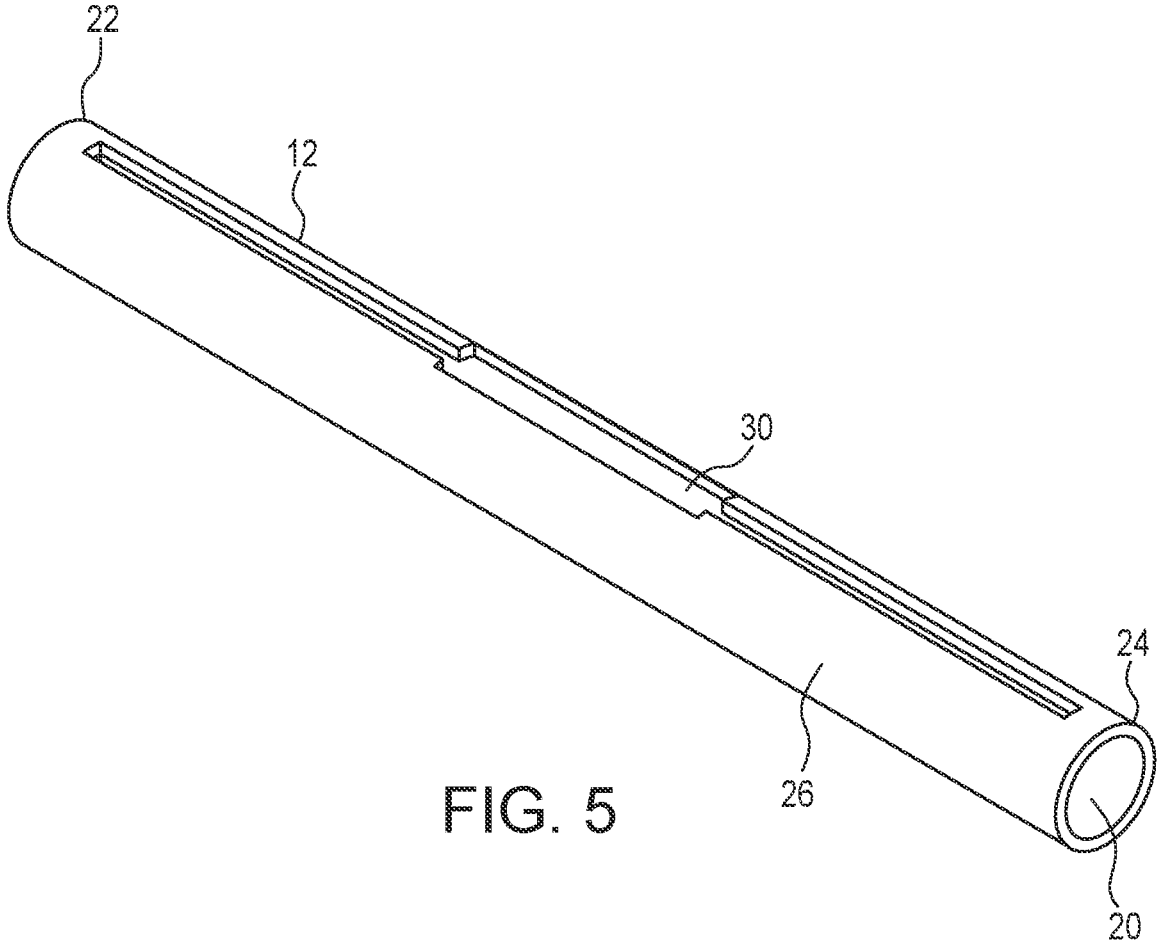
FIG. 5 is a bottom side perspective view of a tube of the lifting device of FIG. 1.

In some embodiments, the tube sidewall 26 may include an aperture or a plurality of apertures. The diameter of each tube sidewall 26 aperture may be about 0.38 inches. A plurality of apertures may be arranged in line with the longitudinal axis. The tube sidewall apertures may be arranged in pairs and have round edges. For example, as shown in FIG. 4, in order and all in line with the longitudinal axis: two apertures 26*a*, 26*b*, the first slot 28, and then two more apertures 26*c*, 26*d*. The first tube aperture 26*a* may be about 5 inches from the first end 22 of the tube 12 and the second tube aperture 26*b* may be about 15 inches from the first end 22 of the tube 12. The third tube aperture 26*c* may be about 15 inches from the second end 24 of the tube 12 and the fourth tube aperture 26*d* may be about 5 inches from the second end 24 of the tube 12.

The insert 14 includes several components. The insert 14 has a first end 32 and a second end 34. The distance between the first end 32 and the second end 34 may be about 44 inches. The insert 14 includes a first projection 36, a second projection 38, and a central portion 40 that extends between the first projection 36 and the second projection 38. The distance between the side of the first projection 36 facing away from the second projection 38 and the side of the second projection 38 facing away from the first projection 26 may be about 11.69 inches. The first projection 36 is connected to the second projection 38 by the central portion 40 of the insert 14. The first projection 36, second projection 38, and central portion 40 of the insert 14 may be formed as one integral component or may be formed as separate components. For example, in FIG. 14 and FIG. 16, the first projection 36, the second projection 38, and the central portion 40 of the insert 14 together are an integral structure. In some embodiments, the width of the first projection 36, the width of the second projection 38, and the width of the central portion 40 of the insert 14 are at least substantially the same. This substantially the same width may be about 1.25 inches.

The length of a portion of the second projection 38 between the first end 32 and a side of the central portion 40 of the insert 14 may be about 16.50 inches. The length of a portion of the second projection 38 between the second end 34 and a side of the central portion 40 of the insert 14 may be about 16.50 inches. The length of a portion of the second projection 38 between the first end 32 and a side of the first projection 36 may be about 18 inches. The length of a portion of the second projection 38 between the second end 34 and a side of the first projection 36 may be about 18 inches.

The first projection 36 may extend radially outward from the longitudinal axis and perpendicular to the longitudinal axis. The second projection 38 may extend radially outward from the longitudinal axis in the direction opposing the first projection 36 and perpendicular to the longitudinal axis, so that the first projection 36 and the second projection 38 are aligned on the same plane.

The insert 14 is disposed at least partially within the tube 12. The first projection 36 extends radially outwardly through the first slot 28 and the second projection 38 extends radially outwardly (in a direction opposing the extension of the first projection 36) through the second slot 30. As previously discussed, the tube 12 has a circumference. The first projection 36 extends out of the tube 12 through the first slot 28 at 0 degrees and the second projection 38 extends out of the tube 12 through the second slot 30 at 180 degrees. Therefore, the first projection 36 and the second projection 38 are aligned on the same plane and across from each other.

Figure 14:
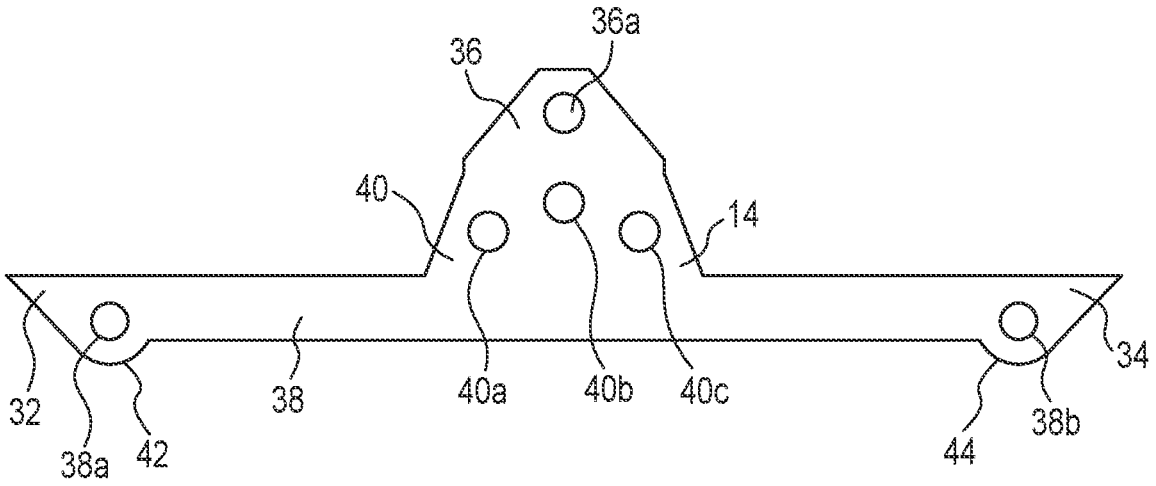
FIG. 14 is a front view of an insert of the lifting device of FIG. 1.
Figure 16:
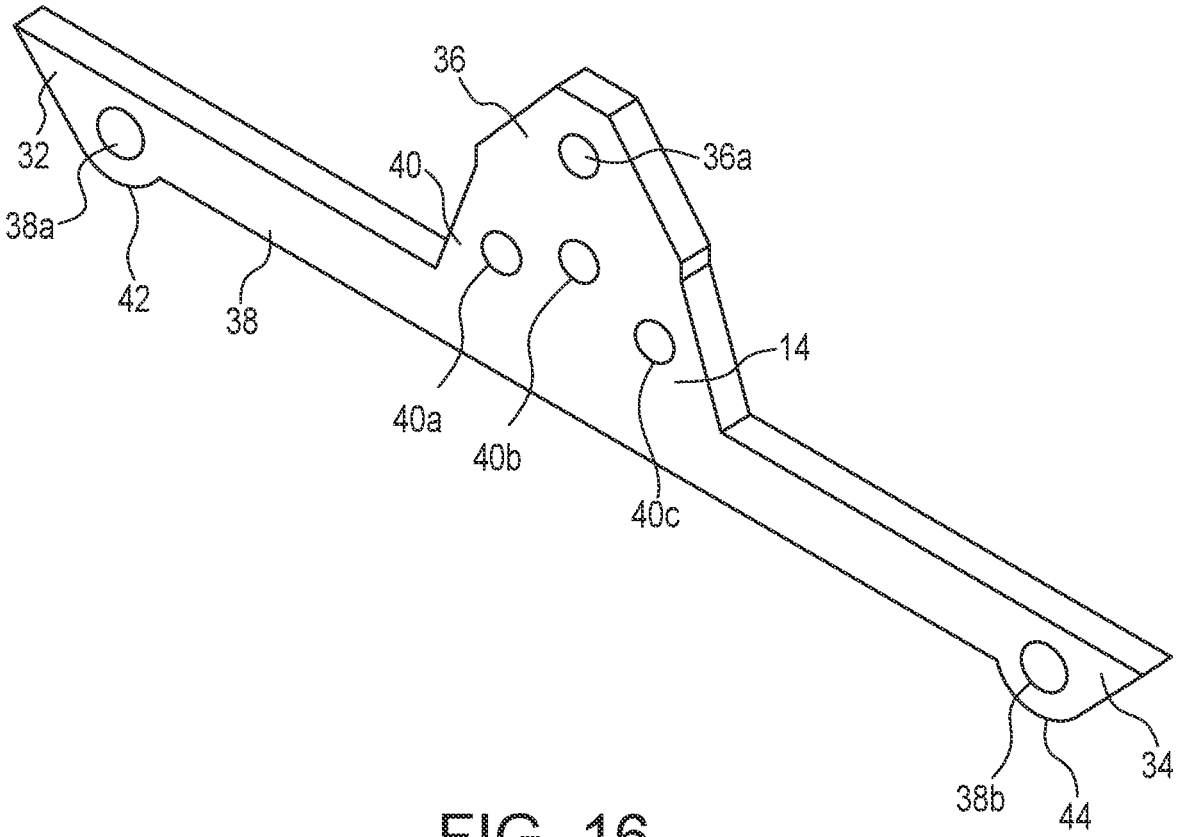
FIG. 16 is a top front perspective view of an insert of the lifting device of FIG. 1.

The insert 14 includes a plurality of apertures. As shown in FIG. 14 and FIG. 16, the first projection 36 has an aperture 36*a*, the second projection 38 has two apertures 38*a*, 38*b*, and the central portion 40 of the insert 14 may have one or a plurality of apertures 40*a*, 40*b*, 40*c*. In other embodiments, the central portion 40 of the insert 14 may be formed without apertures. One, some, or all of the insert apertures 36*a*, 38*a*, 38*b*, 40*a*, 40*b*, 40*c* may have round edges and diameters smaller than the diameter of the sidewall apertures 26*a*, 26*b*, 26*c*, 26*d*. The insert apertures 36*a*, 38*a*, 38*b*, 40*a*, 40*b*, 40*c* may each have a diameter of about 1.50 inches. In some embodiments, the second projection 38 has no apertures. In some embodiments, the second projection 38 has no feet 42, 44.

Figure 15:
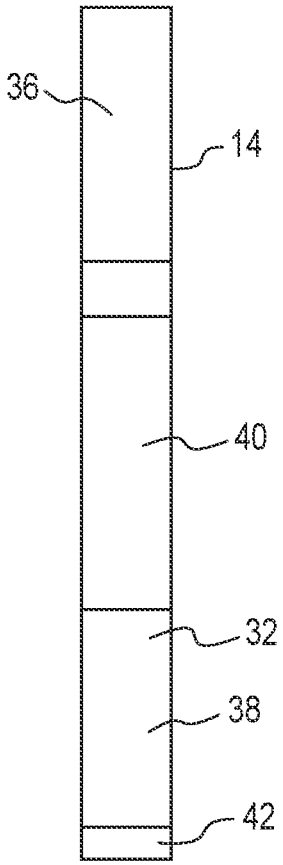
FIG. 15 is a side view of an insert of the lifting device of FIG. 1.

The first projection 36 may be shaped as an irregular polygon. For example, the first projection 36 in FIG. 14 and FIG. 16 has six sides. All sides may be straight, while in other embodiments, one, some or all of the sides may be arcuate. In other embodiments, the first projection may be different shapes such as square, rectangular, trapezoidal, or other geometric shapes known in the art. Alternatively, the first projection 36 may be a curved shape that mimics one of the geometric shapes listed above, or a more amorphous shape. The first projection may include a central extension. As shown in FIGS. 14-16, the longest side of the first projection 35 may be connected to or formed integrally with the central portion 40 of the insert 14. The first projection aperture 36*a* may be located centrally within the first projection 36.

Figure 8:
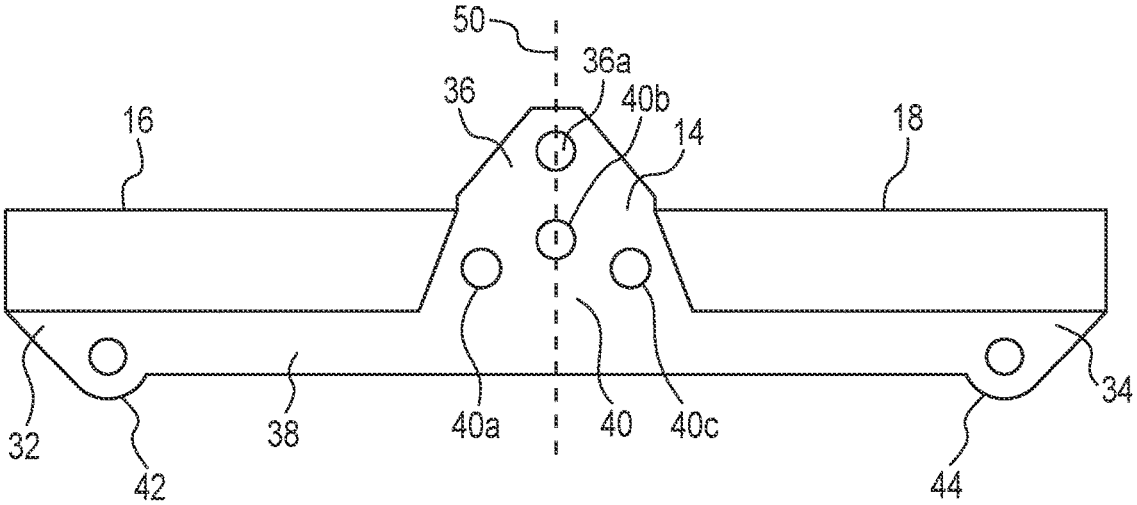
FIG. 8 is a side view of an insert and two plates of the lifting device of FIG. 1.
Figure 9:
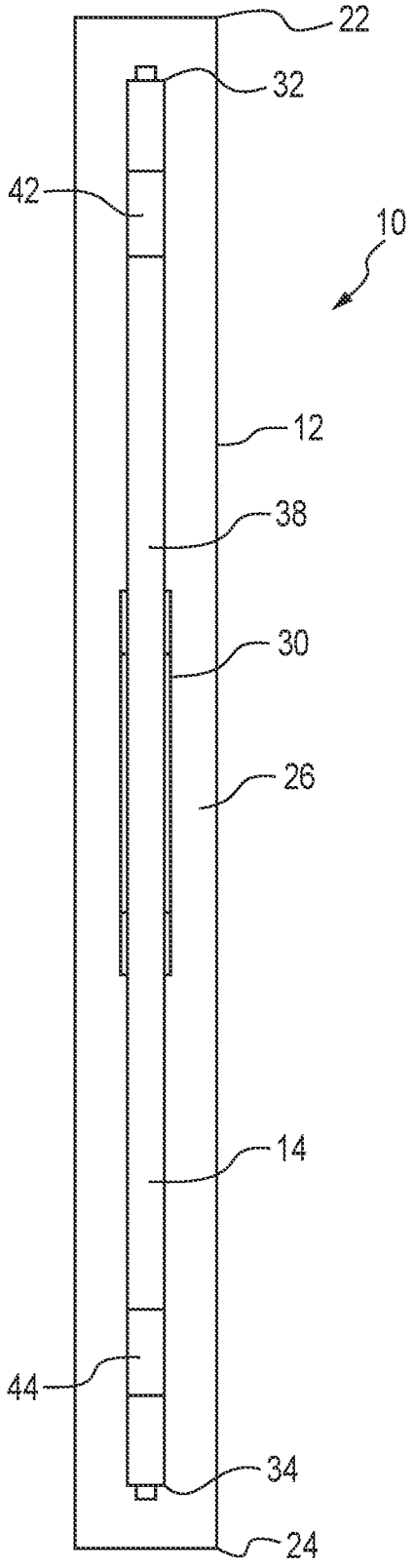
FIG. 9 is a bottom view of the lifting device of FIG. 1.

The second projection 38 may have a bar shape with a radially inward facing surface and a radially outward facing surface, with respect to the longitudinal axis. The lateral distance between the radially inward facing surface and the radially outward facing surface may be about 3.44 inches. A person having ordinary skill in the art would understand that the second projection 38 is not limited to a bar shape. For example, the central portion 40 of the insert 14 may have a square, rectangular, trapezoidal, or cylindrical shape. Alternatively, the second projection 38 may have a curved shape that mimics one of the geometric shapes listed above, or a more amorphous shape. The second projection 38 may define a point at the first end of the insert 32 and may define a point at the second end of the insert 34. The point shapes may be formed from the radially-outwardly facing surface of the second projection 38 angling radially inward and meeting with the radially inward facing surface of the second projection 38. In some embodiments, for example as shown in FIG. 8, the insert 14 may be symmetrical about a lateral centerline 50 between the first and second ends 32, 34. The length from the first end 32 of the insert 14 to the insert lateral centerline 50 may be about 22 inches, and the length from the second end 34 of the insert 14 to the insert lateral centerline 50 may also be about 22 inches.

The second projection 38 includes a first foot 42 and a second foot 44. The second projection aperture 38*a* may be located at least partially on the first foot 42 and the other second projection aperture 38*b* may be located at least partially on the second foot 44. The first foot 42 and the second foot 44 are in line with the longitudinal axis. The first foot 42 and second foot 44 may each have a rounded surface and extend from the second projection 38 away from the first projection 36. Each of the first foot 42 and the second foot 44 may be a half-oval shape with a lateral centerline, where each foot 42, 44 is symmetrical about each lateral centerline. The distance between an inward point of each foot 42, 44 may be about 32.98 inches. The distance between the first end 32 of the insert 14 and a central point of the first foot 42 may be about 4 inches. The distance between the second end 34 of the insert 14 and a central portion of the second foot 44 may be about 4 inches. The lateral distance from the center of the first projection 36 aperture 36*a* to the outward facing surface of the first foot 42 or the second foot 44 may be about 9.94 inches.

As shown in FIGS. 14-16, the central portion 40 of the insert 14 may be a trapezoid shape. A person having ordinary skill in the art would understand that the central portion 40 of the insert 14 is not limited to a trapezoid shape. For example, the central portion 40 of the insert 14 may have be square or rectangular. In the insert 14 depicted in FIGS. 14-16, the central portion of the insert has two parallel sides, one longer than the other. The parallel sides are connected by two angled sides that each extend from the shorter side to the longer side. The longer side of the central portion 40 of the insert 14 is connected to or formed integrally with the second projection 38 and the shorter side of the insert 14 is connected to or formed integrally with the first projection 36. The longer side and shorter side of the central portion 40 of the insert 14 are in line with the longitudinal axis. The lateral distance from the center of the central portion 40 of the insert 14 aperture 40*b* to the outward facing surface of the first foot 42 or the second foot 44 may be about 6.44 inches. The lateral distance from the central portion 40 of the insert 14 aperture 40*a* or 40*c* to the outward facing surface of the first foot 42 or the second foot 44 may be about 5.19 inches. The longitudinal distance from the center of the central portion 40 of the insert 14 aperture 40*a* to the first end 32 of the insert 14 may be about 19 inches. The longitudinal distance from the center of the central portion 40 of the insert 14 aperture 40*c* to the second end 34 of the insert 14 may be about 19 inches.

Figure 10:
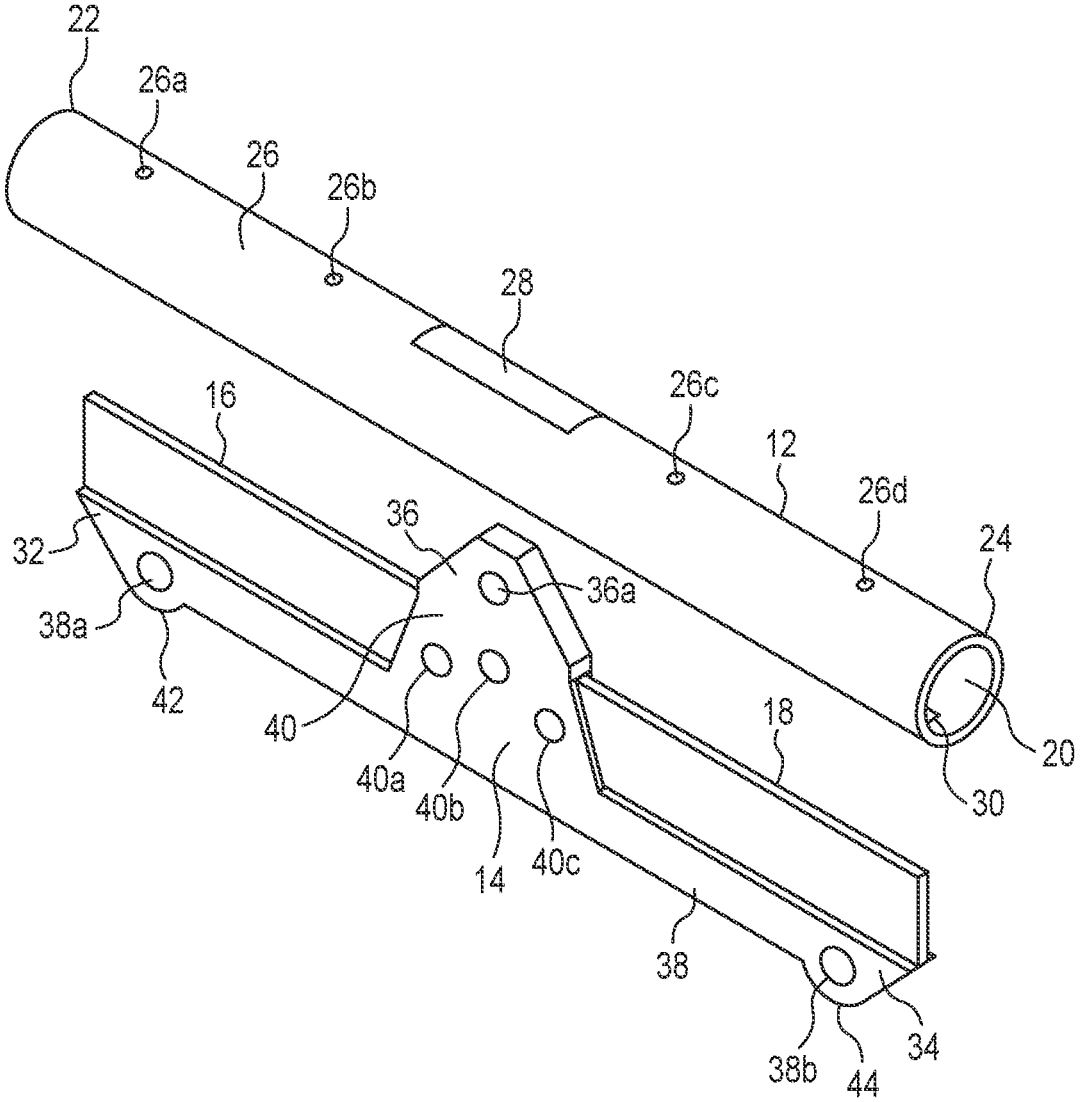
FIG. 10 is an exploded view of the lifting device of FIG. 1.
Figure 11:
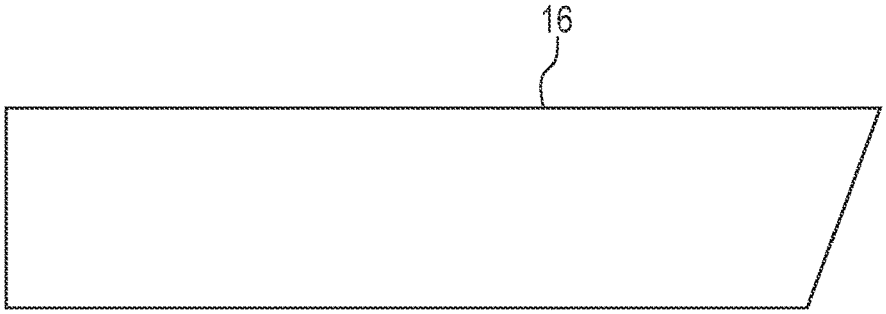
FIG. 11 is a front view of a plate of the lifting device of FIG. 1.
Figure 12:
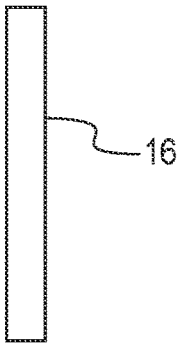
FIG. 12 is a side view of a plate of the lifting device of FIG. 1.
Figure 13:
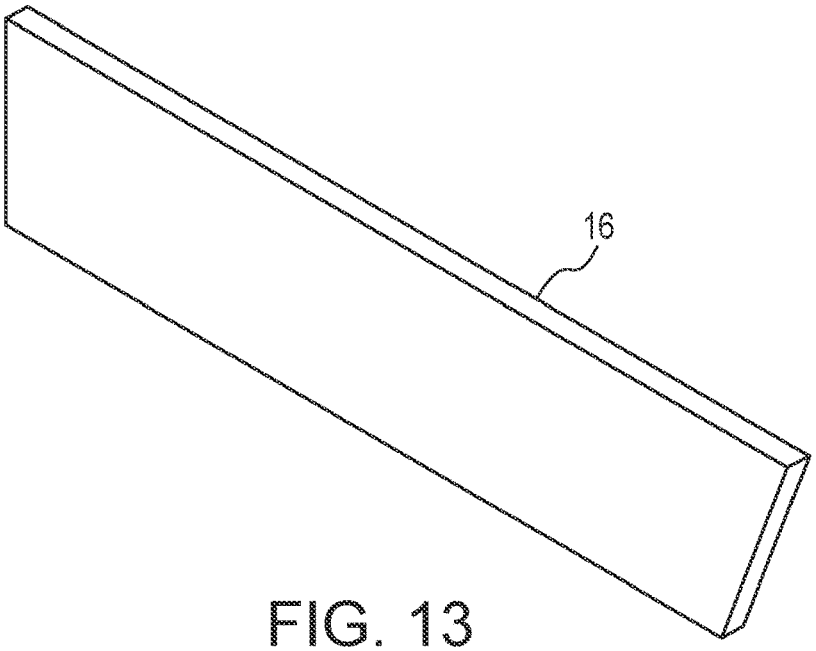
FIG. 13 is a top front perspective view of a plate of the lifting device of FIG. 1.

A first plate 16 and a second plate 18 are connected to the insert 14. The first plate 16 and second plate 18 may be shaped as at least substantially flat panels. Each plate 16, 18 has four sides and two faces. Generally, each plate 16, 18 is substantially rectangular with at least one angled side, as shown in FIGS. 11-13. Two sides are parallel with each other and the longitudinal axis. One parallel side may be about 18 inches long and the other parallel side may be about 16.5 inches long. Another side is perpendicular to the longitudinal axis and connects the other ends of the two parallel sides. This perpendicular side may be about 4.13 inches long. The last side is angled and connects the two parallel sides. As shown in FIG. 8 and FIG. 10, the first plate 16 and the second plate 18 may be connected to the central portion 40 of the insert 14 at each plate's angled side. Therefore, the angled side of the first plate 16 and the angled side of the second plate 18 face inward on the device, towards the central portion 40 of the insert 14. The perpendicular side of the first plate 16 faces towards the first end of the insert 32 and the perpendicular side of the second plate 18 faces towards the second end of the insert 34. The first plate 16 and the second plate 18 are thinner (regarding the width between the two faces of each plate 16, 18) than the second projection 38. For example, the width of each plate 16, 18 may be about 0.50 inches.

The first plate 16 and the second plate 18 may also be connected to the tube 12. The first plate 16 and the second plate 18 each extend from the radially inwardly facing surface of the second projection 38 (as shown in FIG. 10) to an internal surface of the tube sidewall 26. The first plate 16 and the second plate 18 extend from the radially inwardly facing surface of the second projection 38 through the tube sidewall 26 through the second slot 30. For example, in FIGS. 1, 7, and 9, the first plate 16 extends through the second slot 30 at the first portion of the tube 12 and the second plate 18 extends through the second slot 30 at the second portion of the tube.

The first plate 16 and the second plate 18 are each welded to the insert 14 and the tube 12. For example, in FIG. 8 and FIG. 10, the angled side of each plate 16, 18 is welded to an angled side of the central portion 40 of the insert 14. One of the parallel sides of each plate 16, 18 is welded to the second projection 38 and the other parallel side of each plate 16, 18 is welded to an internal surface of the tube sidewall 26. The plates 16, 18 may be welded to the tube through the sidewall apertures 26*a*, 26*b*, 26*c*, 26*d*.

Each of the tube 12, the insert 14, the first plate 16, and the second plate 18 include a non-sparking metal. The lifting device 10 components may be 100% composed of a non-sparking metal or at least 50% composed of a non-sparking metal. Non-sparking metals include aluminum. Another benefit of aluminum may be its lightweight qualities. In some embodiments, lifting device 10 components may be made of a sparking metal or less than 50% non-sparking metal for use in lifting where there is no combustion risk, for example, lifting a box. For these uses, steel or other alloys could be suitable materials. However, some uses of a lifting device 10 are more suitable for at least a portion of the lifting device 10 to be composed of non-sparking metal, for example, lifting a tanker truck containing potentially flammable liquid or residue of a flammable liquid.

The lifting device 10 is capable of supporting heavy weight. For example, a lifting device 10 may support a weight of at least 40,000 pounds. A lifting device 10 may support a working load of at least 15,000 pounds using a 4 to 1 design factor. For example, a device with dimensions as described herein from aluminum would be suitable for a weight of at least 40,000 pounds.

The lifting device 10 may be packaged as a kit. For example, one lifting device 10, or a plurality of lifting devices 10 with shackle(s) (not shown), snatch block(s) (not shown), winch line(s) (not shown), and/or other lifting components for use with the lifting device(s).

A lifting device 10 is used to upright an overturned tanker 54, including a combination of an overturned tanker 54 and an overturned truck. The length of the tube 12 along the longitudinal axis of the tube 12 that will be used to upright an overturned tanker 54 is greater than a longest opening dimension, or in some embodiments the diameter of a tanker hatch 52. A hatch 52, for example, may be 20 inches in diameter with a rectangular manway of 12 inches wide by 20 inches long. Other hatch diameter sizes may range from about 10 inches to about 36 inches. A hatch diameter size may also be within a range of 20 inches to 30 inches. Other hatch sizes, manway sizes, and manway shapes may be understood by one of ordinary skill in the art.

In one example of a lifting device 10, the first projection 36 is about 8 inches long along the longitudinal axis and the first projection 36 is centered on the tube 12, the tube 12 being about 48 inches long. The effective length of the tube 12 from the first end 22 of the tube 12 to a side of the first projection 36 furthest from the first end 22 is 28 inches. The effective length of the tube 12 from the second end 24 of the tube 12 to a side of the first projection 26 furthest from the second end 24 is also 28 inches. For this example, the lifting device 10 would be suitable at least for use in manways of 27 inches and below in diameter without concern of the lifting device 10 becoming dislodged from the manway opening (or other manways, for example of lengths between about 27 inches and about 44 inches) when precautions are taken to keep the lifting device 10 from sliding too far in the tanker manway along the longitudinal axis.

Figure 17:
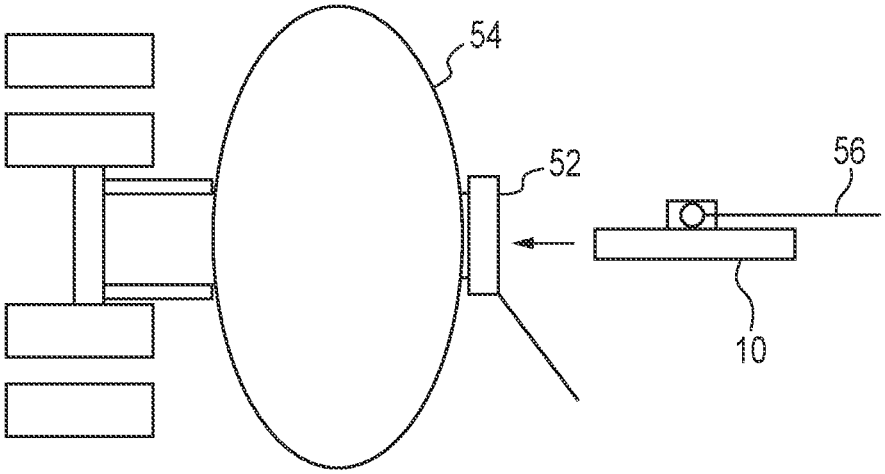
FIG. 17 is an end view of an overturned tanker truck and the lifting device of FIG. 1 outside of the tanker truck.

In some embodiments, a lifting device 10 where the tube 12 as described herein is used with respect to a hatch size as mentioned above. In this example, the tanker truck is overturned onto its side, as shown in FIG. 17. (If the tank contained liquid when the tanker truck overturned, a user may first drain all or part of the fluid out of the tank to decrease the weight of the tanker truck for an easier lift to the extent that that is physically and practically possible in view of the environment in which the method is carried out and to the extent that the tank can be drained in a safe and effective manner.)

Figure 18:
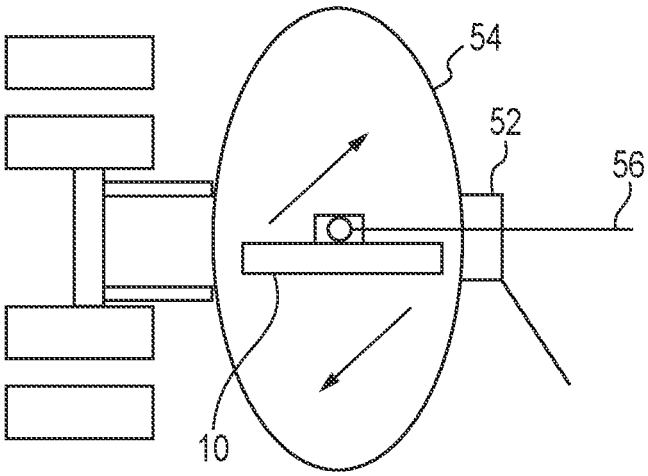
FIG. 18 is an end view of the tanker truck of FIG. 17 with the lifting device of FIG. 17 inside of the tanker truck.
Figure 19:
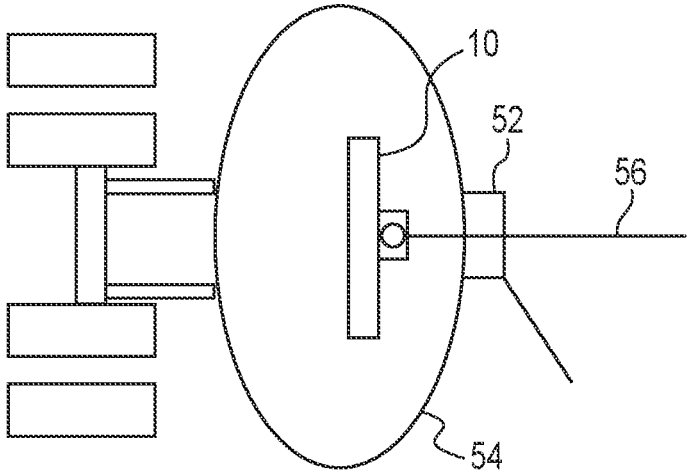
FIG. 19 is an end view of the tanker truck of FIG. 18 with the lifting device of FIG. 18 oriented with the first protrusion towards the tanker hatch.
Figure 20:
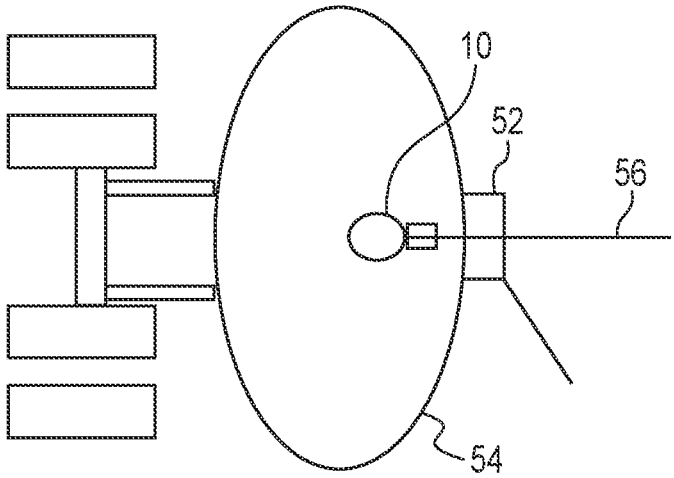
FIG. 20 is an end view of the tanker truck of FIG. 19 with the lifting device of FIG. 19 oriented with the first end of the tube pointing towards the front of the tanker truck and the second end of the tube pointing towards the back of the tanker truck.
Figure 21:
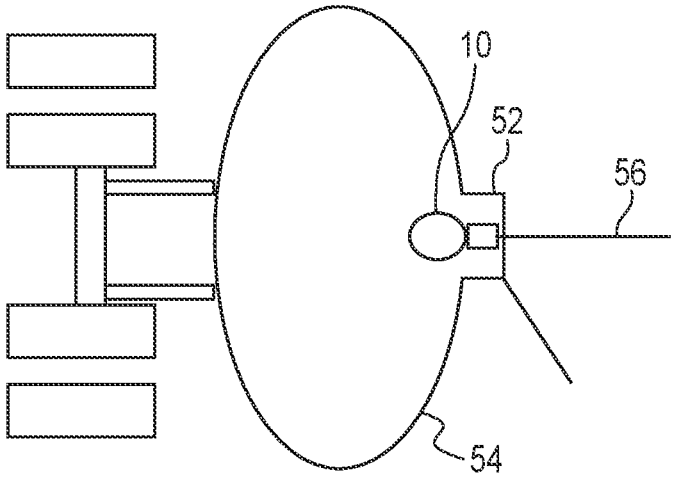
FIG. 21 is an end view of the tanker truck of FIG. 20 with the lifting device of FIG. 20 pulled towards the tanker truck hatch.
Figure 24:
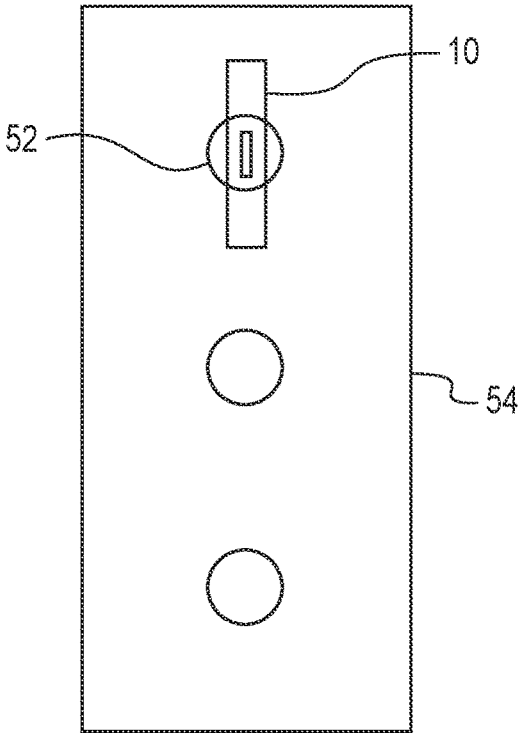
FIG. 24 is a top view of the tanker truck of FIG. 23 with the lifting device of FIG. 22 inside of the tanker truck oriented with the first end of the tube pointing towards the front of the tanker truck and the second end of the tube pointing towards the back of the tanker truck.

A user inserts a lifting device 10 into the open hatch 52 of a tank of a tanker truck. Since the length of the tube 12 is longer than the largest opening or diameter of the open tank hatch 52, the tube 12 is inserted through the hatch 52 and into the tank with either the first end 22 or the second end 24 inserted into the hatch 52 first (following the direction of the arrow in FIG. 17). Once the entire tube 12 is inside the tank (FIGS. 18-19), the tube 12 may be configured so that the first end of the tube 22 points towards the front of the tanker truck and the second end of the tube 24 points towards the back of the tanker truck, as shown in FIG. 20 and FIG. 24. The tube 12 is aligned so that the tube sidewall 26 contacts the inner wall of the tank on opposite sides of the hatch 52, i.e. with the tube 12 bridging under the hatch 52 as shown in FIG. 21.

The lifting device 10 is connected to the first projection 36 by at least one intervening component 56, such as one or more chains, or ropes. The lifting device 10 may be connected to a lifting machine prior to insertion of the tube 12 into the tank. The user may utilize a lifting machine, such as a crane, to provide the lifting force. The lifting device 10 is connected to a lifting machine through intervening components 56, for example, shackle(s), snatch block(s), and winch line(s). For example, a user connects a shackle to the first projection 36 at the first projection's aperture 36*a*. The user connects a snatch block and a winch line to the shackle. A person having ordinary skill in the art would recognize other connecting components that could be used to connect the lifting device 10 to the lifting machine. The totality of the components connecting the lifting device 10 to the lifting machine should be reliable so as to maintain the connection during a lift.

Figure 22:
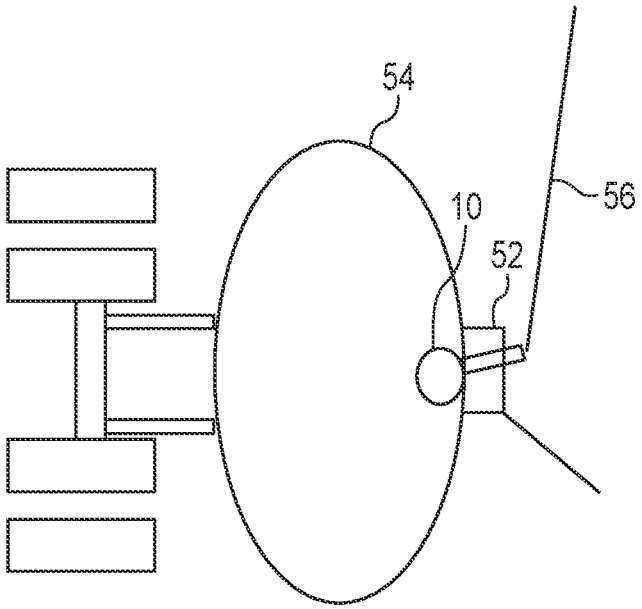
FIG. 22 is an end view of the tanker truck of FIG. 21 with the lifting device of FIG. 21 pulled upward by a lifting machine.
Figure 23:
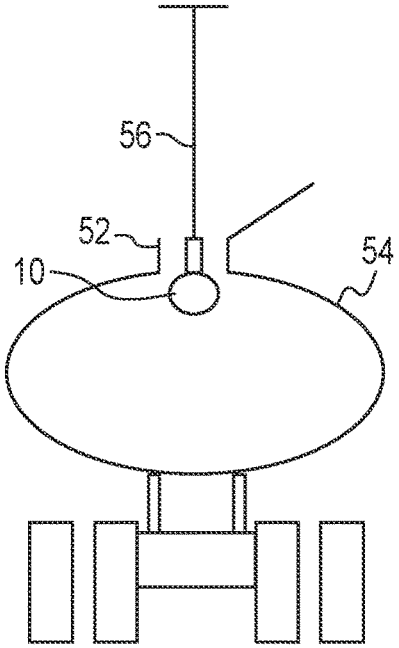
FIG. 23 is an end view of the tanker truck of FIG. 22 with the lifting device of FIG. 22 inside of the tanker truck and the tanker truck upright.

With the tube 12 within the tank and connected to a lifting machine, the lifting machine provides an upward force for lifting the lifting device 10, as shown in FIG. 22. The tube 12 is configured during lifting so that the first end of the tube 22 points towards the front of the tanker truck and the second end of the tube 24 points towards the back of the tanker truck. The tank is moved by the pressure applied by the lifting device to the inside of the tank. The rounded shape of the tube sidewall 26 may roll against (or may slide along) the inside of the tank as the lifting device 10 pulls the tank upwards. Movement of the tank may also simultaneously move the tanker truck as a whole in situations where the overturned tank is attached to an overturned truck. As the tank is lifted upwards, the overturned tanker truck uprights, as shown in FIG. 23.

A second lifting device 10 may be used in combination with the first lifting device 10 to upright a tanker truck. The tank of a tanker truck generally has more than one hatch 52. A user inserts a second lifting device 10 into a different tank hatch, in the same manner as described above regarding the first lifting device 10. The user attaches the second lifting device 10 to a different lifting machine, or in some embodiments the same lifting machine. Both lifting devices 10 are pulled upwards simultaneously or in some embodiments in a staggered method to ensure the tanker 54 is maintained as horizontal as possible. The use of a second lifting device 10 in a second hatch allows a user to lift a heavier tanker truck, or for two smaller capacity lifting devices to lift an overturned tanker. For example, a larger tanker truck or a tanker truck with some fluid in the tank. One of ordinary skill in the art after a thorough review of this specification will understand that one or more lifting devices 10 may be manipulated to ensure a safe and efficient overturning of a tanker truck and after a thorough review of this specification will be able to contemplate the use of the lifting device 10 for this task in combination with the knowledge of one of ordinary skill with best practices of rigging and/or lifting with cranes or similar devices.

Another use of the lifting device 10 is to lift a load, for example, an object such as a box. A lifting device 10 may be therefore used as a lifting beam. A lifting machine hook may couple to the first projection aperture 36*a* and the load may couple to the second projection apertures 38*a*, 38*b*. A user attaches a lift line through the first projection aperture 36*a*, and a separate lift line through each of the second projection apertures 38*a*, 38*b*. The box is connected to the lifting device 10 using intervening components 56 such as strap(s), chain(s), shackle(s), snatch block(s), and winch line(s). The user attaches the lift lines to a source of upwards force, for example, a lifting machine such as a crane. The user utilizes the lifting machine to provide the upwards force that pulls the lifting device 10 upwards. Since the box is operatively connected to the lifting device 10, the upwards force on the lifting device 10 pulls the box upward. The lifting device 10 may also be used as a spreader bar. A suspension sling couples to a lifting machine, for example by a hook, to the ends of the lifting device which are then coupled to the load.

The method steps do not need to be performed in the exact order presented herein. Also, various lifting tools and accessories may be used in combination with the lifting device 10.

While embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein the first insert projection and the second insert projection are on a same plane.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein the first plate and the second plate are welded to the tube and welded to at least a portion of the insert.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein the first insert projection, the second insert projection, and the central portion of the insert together are an integral structure.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein each of the first plate and the second plate are thinner than the second insert projection.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein the tube further comprises a first cap at a first end of the tube and a second cap at a second end of the tube.

For example, in another embodiment, a lifting device comprises a tube comprising a first slot and a second slot; an insert comprising a first insert projection connected to a second insert projection by a central portion, wherein the first insert projection extends through the first slot and the second insert projection extends through the second slot; and a first plate and a second plate, wherein each of the first plate and the second plate are connected to the central portion of the insert, wherein each of the tube, the insert, the first plate, and the second plate comprise a non-sparking metal, and wherein the non-sparking metal comprises aluminum.

For example, in another embodiment, a method of lifting a tanker truck comprises obtaining a lifting device, comprising a tube comprising a first slot and a second slot, an insert comprising a first insert projection connected to a second insert projection by a central portion, wherein the first insert projection extends through the first slot and the second insert projection extends through the second slot, and a first plate and a second plate, wherein each of the first plate and the second plate are connected to the central portion of the insert; inserting the lifting device into a hatch of a tank of a tanker truck; and applying an upwards force to the lifting device, wherein the lifting machine is connected to the first insert projection.

For example, in another embodiment, a method of lifting a tanker truck comprises obtaining a lifting device, comprising a tube comprising a first slot and a second slot, an insert comprising a first insert projection connected to a second insert projection by a central portion, wherein the first insert projection extends through the first slot and the second insert projection extends through the second slot, and a first plate and a second plate, wherein each of the first plate and the second plate are connected to the central portion of the insert; inserting the lifting device into a hatch of a tank of a tanker truck; and applying an upwards force to the lifting device, wherein the lifting machine is connected to the first insert projection and wherein the lifting machine is connected to the first insert projection by at least one intervening component.

What is claimed is:

1. A lifting device, comprising:

a tube comprising a first slot and a second slot; and an insert comprising a first insert projection connected to a second insert projection by a central portion, wherein the first insert projection extends through the first slot and the second insert projection extends through the second slot, wherein the first insert projection has opposing first and second ends along a longitudinal axis, and wherein the tube has a rounded outer surface positioned axially beyond each of the first and second ends of the first insert projection and arranged in line with the longitudinal axis of the first insert projection.

2. The lifting device of claim 1, further comprising a first plate and a second plate, wherein each of the first plate and the second plate are connected to the insert.

3. The lifting device of claim 2, wherein the first plate and the second plate are each connected to the central portion of the insert.

4. The lifting device of claim 3, wherein each of the first plate and the second plate are substantially rectangular with at least one angled side, wherein the at least one angled side of the first plate and the at least one angled side of the second plate are each connected to the central portion of the insert.

5. The lifting device of claim 2, wherein the first plate and the second plate each extend from a surface of the second insert projection to an internal surface of the tube.

6. The lifting device of claim 2, wherein the first plate and the second plate are each connected to the tube.

7. The lifting device of claim 1, wherein the first insert projection comprises an aperture.

8. The lifting device of claim 1, wherein the central portion of the insert comprises a plurality of apertures.

9. The lifting device of claim 1, wherein the second insert projection further comprises a first foot and a second foot.

10. The lifting device of claim 9, wherein the first foot and the second foot each comprise an aperture.

11. The lifting device of claim 1, wherein the tube further comprises a plurality of tube apertures arranged in line with the longitudinal axis.

12. The lifting device of claim 1, wherein a length of the second slot is greater than a length of the first slot.

13. The lifting device of claim 1, wherein the tube has a circumference, and the first insert projection extends out of the tube at 0 degrees and the second insert projection extends out of the tube at 180 degrees.

14. A method of lifting a vehicle, comprising: obtaining a lifting device, comprising a tube comprising a first slot and a second slot, an insert comprising a first insert projection connected to a second insert projection by a central portion, wherein the first insert projection extends through the first slot and the second insert projection extends through the second slot;

inserting the lifting device into an opening of the vehicle; and applying an upwards force to the vehicle.

15. The method of claim 14, wherein the vehicle is moved by the pressure applied by the lifting device to the inside of the vehicle.

16. The method of claim 14, wherein a length of the tube along the longitudinal axis of the tube is greater than a length of the opening of the vehicle.

17. The method of claim 14, wherein applying an upwards force to the lifting device is performed by a lifting machine.

18. The method of claim 14, wherein the lifting device further comprises a first plate and a second plate, wherein each of the first plate and the second plate are connected to the central portion of the insert.

19. A lifting device, comprising:

a tube comprising a first slot and a second slot; and an insert comprising a first insert projection connected to a second insert projection by a central portion, wherein the first insert projection extends through the first slot and the second insert projection extends through the second slot, wherein the first insert projection spans a first length along a longitudinal axis of the lifting device, wherein the second insert projection spans a second length along the longitudinal axis, and wherein the first length of the first insert projection is shorter than the second length of the second insert projection.

20. The lifting device of claim 19, further comprising a first plate and a second plate, wherein each of the first plate and the second plate are connected to the insert.

* * * * *